US005207728A

United States Patent [19]

Fogarty et al.

[11] Patent Number: 5,207,728

[45] Date of Patent: May 4, 1993

[54] MATERNITY DRESS FOR A DOLL WHICH SIMULATES PREGNANCY

[76] Inventors: A. Edward Fogarty; Bonnie R. Fogarty, both of 39 Sandy Hook Rd., Sarasota, Fla. 34242

[21] Appl. No.: 859,661

[22] Filed: Mar. 30, 1992

[51] Int. Cl.[5] ..... A63H 3/08; A63H 33/22; A63H 3/52; A63H 33/30

[52] U.S. Cl. ..... 446/98; 446/219; 446/267; 446/295; 446/472; 2/69

[58] Field of Search ..... 2/69, 69.5, 73, 104; 446/219, 175, 97, 98, 99, 100, 101, 267, 268, 295, 296, 320, 321, 472, 369; 434/273

[56] References Cited

U.S. PATENT DOCUMENTS

| | | | |
|---|---|---|---|
| 2,619,771 | 12/1952 | Jones | 446/369 X |
| 3,601,923 | 8/1971 | Rosenberg | 446/267 |
| 4,411,629 | 10/1983 | Voights | 434/273 X |
| 4,531,919 | 7/1985 | Ware | 2/69 X |
| 4,883,442 | 11/1989 | Kaplan | 446/320 |
| 4,917,372 | 4/1990 | Zeitlin | 446/267 X |
| 5,032,099 | 7/1991 | Chan | 446/175 |
| 5,104,328 | 4/1992 | Lounsbury | 434/273 |

FOREIGN PATENT DOCUMENTS

| | | | |
|---|---|---|---|
| 0472365 | 2/1992 | European Pat. Off. | 446/295 |

*Primary Examiner*—Robert A. Hafer
*Assistant Examiner*—D. Neal Muir
*Attorney, Agent, or Firm*—Charles J. Prescott

[57] ABSTRACT

A removable maternity dress for a doll which simulates pregnancy and child delivery and which may be easily adapted to a conventional doll. The invention includes a doll dress preferably made of non-stretchable flexible fabric having a concealed upright front pocket connected thereto. The pocket is sized to receive a baby doll insertable therein through a flapped lower opening at the bottom of the pocket. Removal of the baby doll from the pocket downwardly through the lower opening simulates child birth. A front opening in the dress adjacent the pocket coverable by an apron-like fabric sheet may also be provided. A layer of flexible latex or the like connected to and extending across the front opening simulates the appearance of the pregnant mid section of the doll. A liquid or gel-filled bladder attached between the front of the dress and the pocket affords a more realistic sensation of touch of the baby doll within the pocket. A lenticular screen positioned over an image of the baby doll and having a transducer-like extension therefrom affords simulated kicking movement of the baby doll as found on an ultrasound machine.

5 Claims, 2 Drawing Sheets

FIG. 4
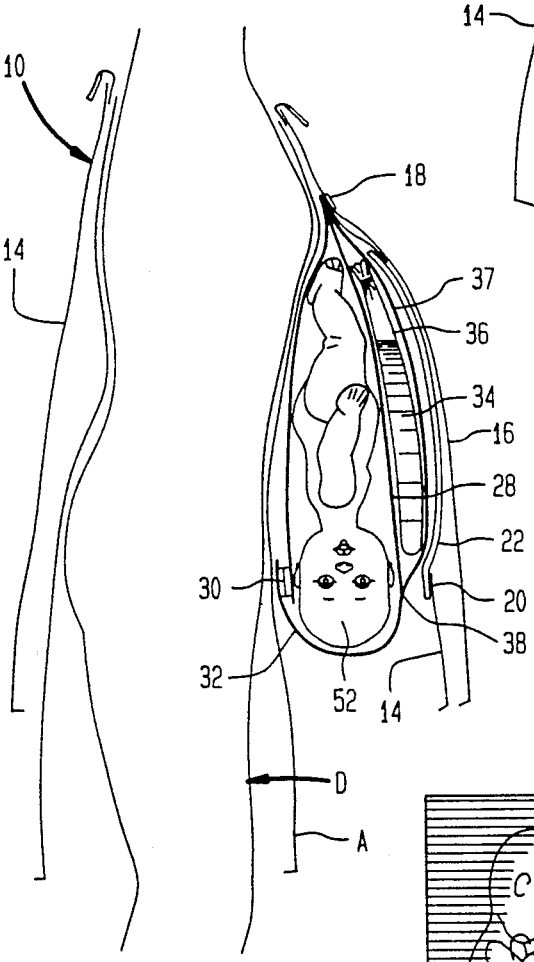
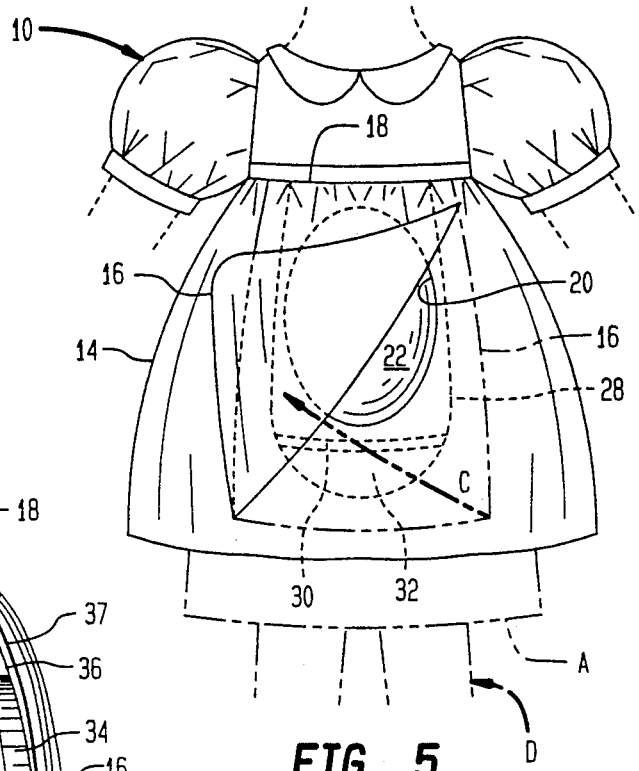
FIG. 5
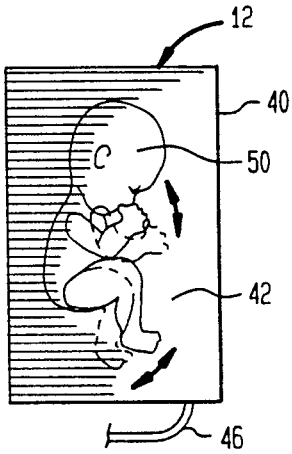
FIG. 6
FIG. 7
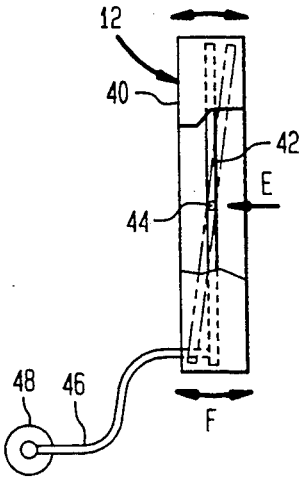

MATERNITY DRESS FOR A DOLL WHICH SIMULATES PREGNANCY

BACKGROUND OF THE INVENTION

This invention relates generally to dolls, and more particularly to a removable maternity dress for a conventional doll which simulates pregnancy and birth.

A number of prior art devices are known which in some fashion simulate pregnancy and birth of a doll or toy animal. However, elements of social unacceptability have rendered many of these prior art devices unmarketable. One such device is disclosed in U.S. Pat. No. 4,883,442 invented by Kaplan. However, this device utilizes an elastic stretchable pouch on the mother doll to impart a realistic pregnant look and which, after removal of the baby doll, conforms to the unpregnant shape of the doll.

An early patent to Overholt in U.S. Pat. No. 1,431,482 discloses a doll capable of carrying a baby doll across its chest held there by snaps. The disclosures in U.S. Pat. Nos. 2,551,433 and 2,551,560 teach the use of manikins for mid-wifery instruction and which include an abdominal cavity into which a baby doll may be placed. However, a rigid cap or cover is utilized to cover the pregnancy appearance.

In the U.S. Pat. Nos. 3,812,613 to Glass, and 4,183,171to Tarzian, pregnant mother dolls are disclosed which, in the first patent utilizes a spring neck mechanism for expanding the abdomen and, in the later case, relies upon a mechanical cam to simulate a pregnant appearance.

A doll with a pouch is disclosed in U.S. Pat. No. 4,197,670 to Cox, an educational toy doll having a cavity covered by a hingedly connected door within which a baby doll may be carried. However, this invention is structured so as to have the appearance of baby doll placement and removal from a frontal opening in the stomach.

Two somewhat more distant inventions related to toy animals are disclosed in U.S. Pat. Nos. 4,874,344 to Kanter and 4,237,649 to Goldfarb.

The present invention provides a more socially acceptable, yet realistic arrangement which includes a removable maternity dress for a conventionally shaped (non-pregnant) doll. Thus, the invention may be totally removed and the doll and its conventional clothes then used in a normal fashion. No additional structure is required to effect the appearance of pregnancy or the simulation of giving birth to a baby doll. The invention, because structured of a loosely fitting maternity dress, will also easily fit over a variety of appropriately sized conventional dolls which may remain fully clothed under the maternity dress. This invention is equally adaptable for wearing and use by small children.

BRIEF SUMMARY OF THE INVENTION

This invention is directed to a removable maternity dress for a doll which simulates pregnancy and child delivery and which may be easily adapted to a conventional doll. The invention includes a doll dress made of preferably non-stretchable flexible fabric having a concealed front upright pocket or pouch connected thereto. The pocket is sized to receive a baby doll insertable therein through a flapped lower opening at the bottom of the pocket. Removal of the baby doll from the pocket downwardly through the lower opening simulates child birth. A front opening in the dress adjacent the pocket coverable by an apron-like fabric sheet may also be provided. A layer of rounded flexible latex or the like connected to and extending across the front opening simulates the appearance of the pregnant mid section of the doll. A liquid or gel-filled bladder attached between the front of the dress and the pocket affords a more realistic sensation of touch of the baby doll within the pocket. A lenticular screen positioned over an image of the baby doll and having a stethoscope-like extension therefrom affords simulated kicking movement of the baby doll.

It is therefore an object of this invention to provide a removable maternity dress for use in conjunction with a conventional similarly sized doll which simulates pregnancy and child birth.

It is yet another object of this invention to provide a socially acceptable means by which a child can play with a conventional doll which may take on a simulated appearance of pregnancy and which simulates child birth, after which the doll may be used in a conventional manner.

It is yet another object of this invention to provide a removable maternity dress which more realistically simulates the appearance and feel of pregnancy.

It is yet another object of the above invention to be adaptable for small children.

In accordance with these and other objects which will become apparent hereinafter, the instant invention will now be described with reference to the accompanying drawings.

BRIEF DESCRIPTION OF THE DRAWINGS

FIG. 4 is a side elevation schematic section view of the removable maternity dress in place over a conventional, dressed doll.

FIG. 5 is a front elevation view of FIG. 4.

FIG. 6 is a front elevation view of a lenticular screen device for simulating kicking movement of the baby as on an ultrasound machine prior to simulated child birth.

FIG. 7 is a side elevation view of FIG. 6.

DETAILED DESCRIPTION OF THE INVENTION

Figure 1:
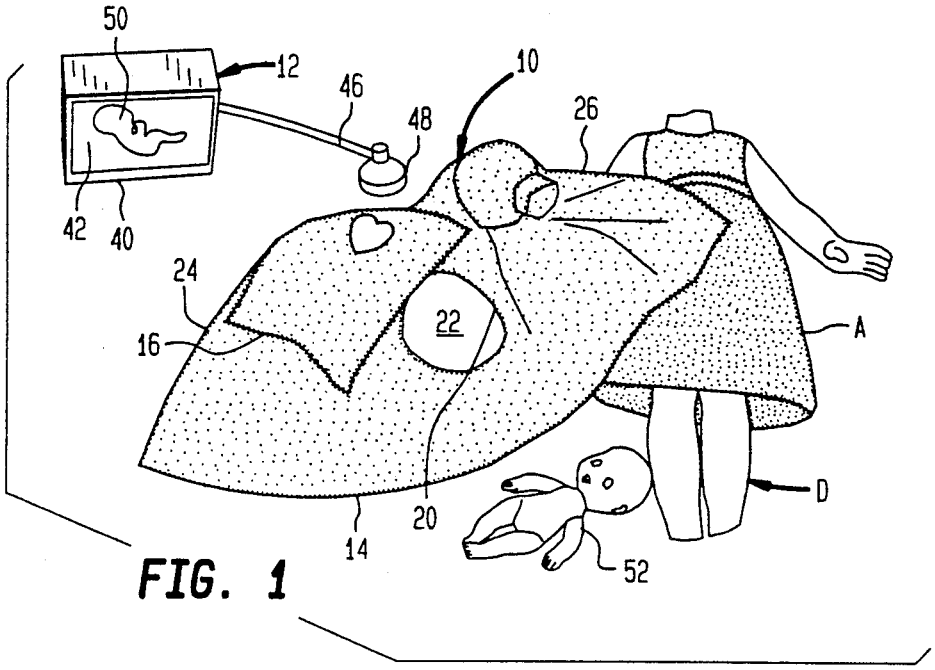
FIG. 1 is a perspective view of the preferred embodiment of the invention removed from a conventional, dressed doll.

Referring now to the drawings, the preferred embodiment of the invention includes a maternity dress shown generally at numeral 10 and a lenticular screen device shown generally at numeral 12, both of which will be described herebelow.

A conventional doll D may be utilized in conjunction with the appropriate sized maternity dress 10. The doll D may be clothed with conventional doll clothing such as a dress A or may be unclothed prior to receiving the maternity dress 10. The maternity dress 10 itself includes a main sheet of flexible fabric 14 cut and sewn into the rear opening of maternity dress 10 having rear upright overlapping margins 24 and 26 which are closable along the central upright back portion of the doll D. Arm sleeves and a neck opening are sewn thereto in a well-known fashion. The dress 14 is preferably non-stretchable and loosely fitted.

Figure 3:
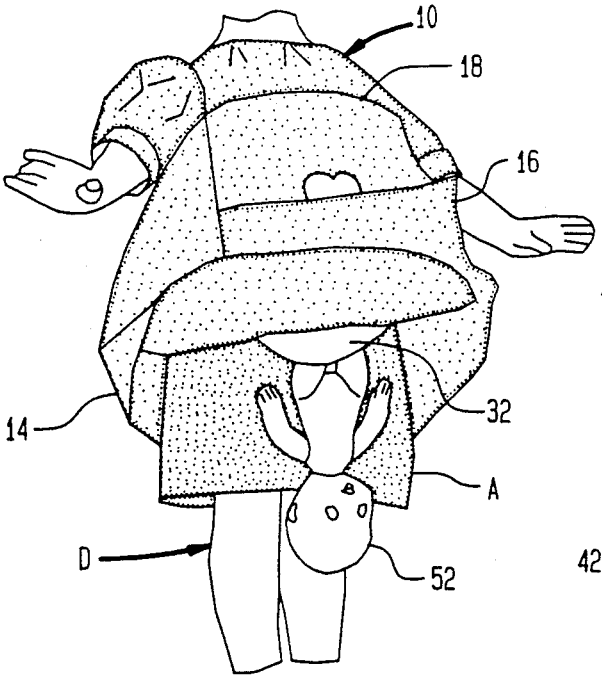
FIG. 3 is a perspective view of FIG. 2 depicting simulated child birth.

A pocket 28 fabricated of a similar flexible non-stretchable fabric material is also provided connected by stitching along 18 in the region of the bodice of the doll D to the inner front surface of main dress portion 14. This pocket 28 includes a lower openable flap 32 held closed by two part loop and pile material at 30 and is sized so that a baby doll 52 may be inserted therein, preferably in an inverted position as best seen in FIG. 4. After the baby doll 52 is inserted upwardly into pocket 28, closable flap 32 will then retain this arrangement until such time as the baby doll 52 is to be removed from the pocket 28 as best seen in FIG. 3. By disengaging flap 32, the baby doll 52 may be pulled downwardly from the pocket 28 so as to simulate child birth.

To add a further level of realism to the invention, the preferred embodiment includes an oval-shaped opening 20 formed into the front surface of main dress portion 14 immediately opposite the region of the stomach. A convex molded layer of soft latex or vinyl material or the like 22 is attached along its margin within the perimeter of oval opening 20 which has the appearance of an enlarged stomach to simulate pregnancy. Thus, in addition to providing an appearance of pregnancy beyond that caused by placing baby doll 52 within pocket 28 and the resulting enlargement thereof, flexible molded layer 22 provides a cushiony, pliable surface against which a child's fingers may be applied to feel the baby doll 52 within pocket 28.

A movable cover or flap 16 also connected by stitching 18 across the bodice area of the maternity dress 10, is further provided to conceal molded layer 22 then allowed to hang downwardly over the front surface of main dress portion 14. However, cover 16 may be easily lifted in the direction of arrow C in FIG. 5 so as to reveal molded layer 22 as desired.

To yet further enhance the realism of this invention, the preferred embodiment also includes a generally flat latex bladder 36 which is filled with a liquid or gel material 34. This bladder 36 is generally configured in the shape of opening 20 and is suspended immediately in front of and between pocket 28 and a separate sheet of flexible fabric material 37 which is sewn in place as best seen in FIG. 4. By this arrangement, a child wishing to feel the baby doll 52 within pocket 28 will place fingertips onto stomach layer 22 and indirectly feel the baby doll 52 through both the stomach layer 22 and the liquid filled bladder 36. The sense of touch experienced thus more closely simulates reality.

An optional and preferred accessory in the form of a lenticular screen device 12 is shown in FIGS. 1, 2, 6 and 7. This lenticular device 12 includes a lenticular screen 42 pivotally mounted about a central transverse axis 44 within frame 40. An image 50 of the baby doll 52 is positioned immediately behind and against the lenticular screen 42 so that, as the lenticular screen 42 is pivoted about axis 44 in the direction of the arrows in FIG. 7, the image 50 appears to move its arms and legs, simulating movement of a baby as within a womb and as viewed on an ultrasound machine in real life.

Figure 2:
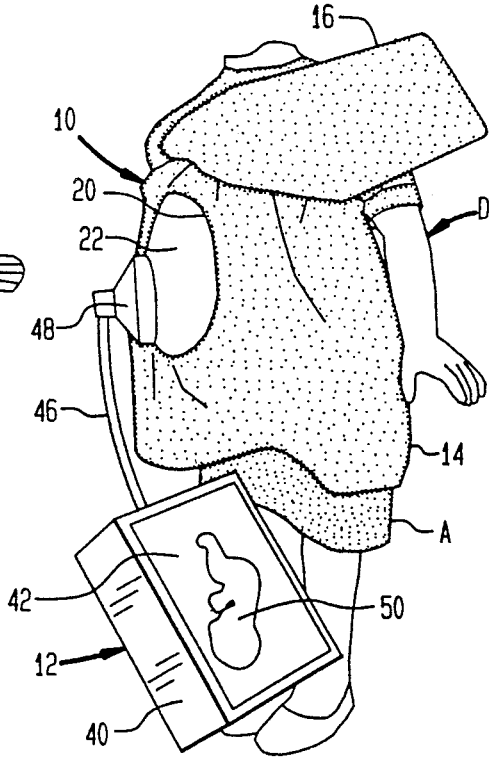
FIG. 2 is a perspective view of FIG. 1 showing the invention in use.

A flexible conduit or tubular member 46 is interconnected at one end to frame 40 and includes a cupped member 48 at the opposite end thereof which is generally shaped in the form of a distal sound receiving end of an ultrasound machine. By this arrangement, a child may place the cupped member 48 onto the stomach layer 22 as seen in FIG. 2 and then view a simulation of baby doll movement by observing movement of image 50 as the lenticular screen 42 is pivoted back and forth. Alternately, the lenticular screen 42 may be fixed within frame 40 and the entire frame 40 pivotally moved by manipulating tubular member 48 so as to cause the baby doll image 50 to move behind the lenticular screen 42.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. A removable maternity dress garment in conjunction with a doll simulating pregnancy of said doll and simulated childbirth of a baby doll comprising:

a flexible fabric sheet formed into a shape of a doll dress loosely fitting over said doll;

an upright pocket connected inside a front surface of said doll dress and having an openable flap at a lower end thereof, said pocket structured to supportively receive said baby doll insertable therein through said openable flap;

said baby doll removal from said pocket downwardly therefrom by opening said flap, simulating the appearance of a baby birth;

a front opening in said dress shaped to expose a second flexible sheet connected to a perimeter of said front opening and smoothly textured and positioned with respect to the doll to simulate a stomach of said doll;

a movable cover formed of a fabric sheet and connected along an upper margin thereof to said doll dress so as to lay over and cover said front opening when said doll is upright.

2. A removable maternity dress for a doll as set forth in claim 1, further comprising:

a liquid or gel-filled latex bladder connected to a front panel of, and generally coextensive with, said pocket;

said bladder structured to cover the baby doll when within said pocket whereby the baby doll may only be touched indirectly through said bladder.

3. A removable maternity dress for a doll as set forth in claim 1, further comprising:

a lenticular screen with an image therebehind connected to one end of a flexible tubular member, the other end of said tubular member having a cup connected thereto having the appearance of the distal end of a transducer as on an ultrasound machine;

said image being the shape of said baby doll which appears to move as said lenticular screen is pivoted as by movement of said tubular member and said cup.

4. A removable maternity dress for a doll which simulates pregnancy of said doll and simulated childbirth of a baby doll comprising:

a fabric sheet formed into a shape of a doll dress;

an upright pocket connected inside a front surface of said doll dress and having an openable flap at a lower end thereof, said pocket structured to supportively receive said baby doll insertable therein through said openable flap;

said baby doll removable from said pocket downwardly therefrom by opening said flap, removal of said baby doll simulating the appearance of a baby birth;

a front opening in said dress shaped to expose a second flexible sheet connected to a perimeter of said front opening and smoothly textured and positioned to simulate a stomach of said doll;

a movable flap formed of a fabric sheet and connected along an upper margin thereof to said doll dress so as to lay over and cover said front opening when said doll is upright;

a liquid or gel-filled latex bladder connected to a front panel of, and generally coextensive with, said pocket;

said bladder structured to cover said baby doll when within said pocket whereby said baby doll may be touched indirectly through said bladder.

5. A removable maternity dress for a doll which simulates pregnancy as set forth in claim 4, further comprising:

a lenticular screen with an image therebehind connected to one end of a flexible tubular member, the other end of said tubular member having a cup connected thereto having the appearance of the distal end of a transducer as on an ultrasound machine;

said image being the shape of said baby doll which appears to move as said lenticular screen is pivoted as by movement of said tubular member and said cup.

* * * * *